US007234598B2

(12) United States Patent
McDade

(10) Patent No.: US 7,234,598 B2
(45) Date of Patent: Jun. 26, 2007

(54) MATERIAL HANDLING CONTAINER WITH CARD HOLDER

(75) Inventor: Clinton McDade, Charlotte, NC (US)

(73) Assignee: Schaefer Systems International, Inc., Charlotte, NC (US)

( * ) Notice: Subject to any disclaimer, the term of this patent is extended or adjusted under 35 U.S.C. 154(b) by 170 days.

(21) Appl. No.: 11/081,204

(22) Filed: Mar. 16, 2005

(65) Prior Publication Data

US 2005/0205454 A1 Sep. 22, 2005

Related U.S. Application Data

(60) Provisional application No. 60/553,458, filed on Mar. 16, 2004.

(51) Int. Cl.
*B65D 21/00* (2006.01)
*B65D 25/20* (2006.01)
*B65D 85/62* (2006.01)

(52) U.S. Cl. ..... 206/505; 220/676

(58) Field of Classification Search ..... 220/676, 220/4.26, 4.27, 729; 206/503–513, 518, 206/519; D3/318

See application file for complete search history.

(56) References Cited

U.S. PATENT DOCUMENTS 2,914,210 A * 11/1959 Paston ..... 220/6
4,779,751 A * 10/1988 Munroe ..... 217/69
5,285,900 A * 2/1994 Swingler ..... 206/508
D375,201 S 11/1996 Karr et al.
D423,220 S * 4/2000 McDade ..... D3/318
6,145,664 A 11/2000 Cope
6,581,771 B2 6/2003 McDade
6,820,761 B1 * 11/2004 Mouri et al. ..... 220/6

FOREIGN PATENT DOCUMENTS

JP 05112362 A * 5/1993
JP 2000033950 A * 2/2000
JP 2004035077 A * 2/2004

* cited by examiner

*Primary Examiner*—Anthony D. Stashick
*Assistant Examiner*—Harry Grosso
(74) *Attorney, Agent, or Firm*—Adams Evans P.A.

(57) ABSTRACT

A container that has a base from which first and second pairs of spaced-apart, opposed sidewalls project to collectively form a storage compartment. An upper rim is positioned on the sidewall for engaging and supporting the base of another container. The lower rim is positioned adjacent the base and adapted for engaging and being supported by an upper rim of another container. A pocket is provided for receiving and retaining an information card therein. The pocket is formed by first and second spaced-apart wall segments projecting from one of the sidewalls. An elongate slot is positioned on the sidewall between the spaced-apart wall segments and the lower rim segment. The lower rim segment is located between the spaced-apart wall segments. The upper and lower rims, elongate slot, and wall segments collectively form the pocket located on the sidewall of the container.

10 Claims, 16 Drawing Sheets

MATERIAL HANDLING CONTAINER WITH CARD HOLDER

TECHNICAL FIELD AND BACKGROUND OF THE INVENTION

The subject invention relates to storage containers, and more particularly to a storage container having a pocket for receiving and retaining an information card or other similar document.

Material handling or storage containers are well known in the art. Commonly used in food, industrial and distribution applications, such containers are not only ergonomically designed to promote ease of manual use, but are also designed to interface with automated material handling systems. Because they are used for storing and transporting a variety of materials, the containers are labeled to make it easy to identify the contents of the containers. In particular, the containers typically include card holders within which standardized cards are positioned and used to display printed information or data, which is later recorded by an automated reader or visually inspected.

Conventional card holders are semi-permanently attached, or "added on" to the containers prior to use, which allows a card to be easily inserted and removed. Because the cards are of uniform size, the card holders are all likewise uniform. However, the containers vary in size and shape from one type of container to another. Because of this, the surface area available on the outer wall of a given container for displaying the card is often too small to completely protect the card from damage during use and may prevent the card from fitting flat against the outer wall. In those containers having shorter walls, the information cards stick out above the upper rims of the containers and are exposed to damage by being folded, torn or inadvertently crushed. In other containers, the surface area allotted for the card is bounded by both a lower rib upon which the lower edge of the information card must rest, and a second, horizontal rib. This effectively restricts the space within which the card may be positioned by forcing the top of the card to curve outwardly along the upper rib. The reduced space also causes the card to bend outwardly and extend beyond the effective footprint of the container, which again subjects the card to damage.

The subject invention addresses the problems associated with conventional card holders by providing a container having a card holder which is designed to maximize the surface area available for supporting an information card without interfering with the function or design of the container. Specifically, the card holder is a pocket that extends below the lower rim of the container and is attached to the base or associated base components. Rather than resting on the lower rim, the lower edge of the card is inserted into the pocket and extends below the lower rim. This effectively increases the surface area on the outside of the container available for displaying the card and minimizes exposure of the upper edge of the card to damage that might otherwise result from normal use of the container, such as stacking the container on a pallet or upon a like container, or positioning the container on a moving conveyor or stationary surface. Applicant's United States Design Patent No. Des. 423,220 discloses a document storage device that is suitable for being positioned into the pocket.

SUMMARY OF THE INVENTION

Therefore, it is an object of the invention to provide a container with a pocket positioned on the side for the storage of an information card.

It is another object of the invention to provide a container for handling and storing items with a pocket positioned on the side of the container that increases the surface area available for supporting an information card.

It is another object of the invention to provide a card storage device for handling and storing items with a pocket positioned on the side of the container that receives the card storage device and thus minimizes the exposure of the upper edge of the card and reduces damage to the card from everyday wear and tear.

These and other objects of the present invention are achieved in the preferred embodiment disclosed below by providing a container that has a base from which first and second pairs of spaced-apart, opposed sidewalls project to collectively form a storage compartment. An upper and lower rim is positioned on the sidewall for engaging and supporting the base of another container. The lower rim is positioned adjacent the base and adapted for engaging and being supported by an upper rim of another container. A pocket is provided for receiving and retaining an information card therein. The pocket is formed by first and second spaced-apart wall segments projecting from one of the sidewalls. An elongate slot is positioned on the sidewall between the spaced-apart wall segments and the lower rim segment. The lower rim segment is located between the spaced-apart wall segments. The upper and lower rims, elongate slot, and wall segments collectively form the pocket located on the sidewall of the container.

According to one preferred embodiment of the invention, intermediate ribs extend outwardly from the sidewalls in horizontal and vertical directions to provide stability to the container.

According to another preferred embodiment of the invention, the container includes provision for receiving a card holder that fits into the pocket and provides additional space for placement of the card without being exposed to damage.

According to yet another preferred embodiment of the invention, a plurality of handles extend from the upper rim and are disposed against the sidewall.

According to yet another preferred embodiment of the invention, a pair of handles are positioned in the sidewalls.

According to yet another preferred embodiment of the invention, reinforcement members are positioned on the corners of the sidewalls.

According to yet another preferred embodiment of the invention, the pocket has a height of about 3.9 inches and a width of about 8.0 inches.

BRIEF DESCRIPTION OF THE DRAWINGS

Some of the objects of the invention having been stated, other objects will become evident as the description proceeds, when taken in connection with the accompanying drawings, in which.

DESCRIPTION OF THE PREFERRED EMBODIMENT AND BEST MODE

Figure 1:
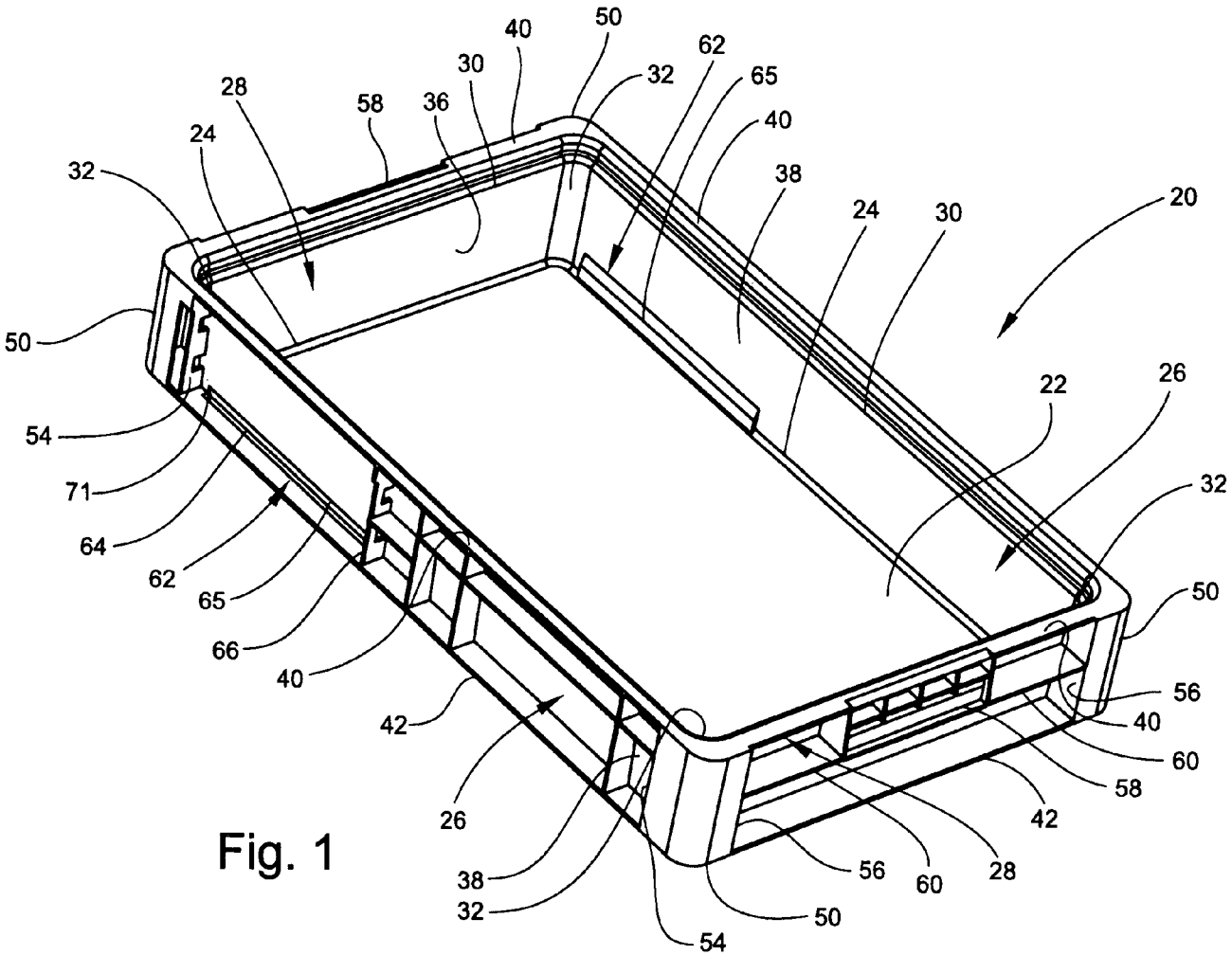
FIG. 1 is a perspective view of a container according to one embodiment of the invention.

Referring now more specifically to the drawings, wherein like numerals indicate like or corresponding parts throughout the several views, a storage container according to one embodiment of the invention is shown generally at 20 in FIGS. 1 through 8. The container 20 includes a base 22 that extends to an outer edge 24. First and second pairs of opposed sidewalls 26, 28 extend at an angle from the outer edge 24 to an upper edge 30. The sidewalls 26, 28 each have inner and outer sidewall surfaces 36, 38. As is shown in FIG. 1, each of the second pair of sidewalls 28 interconnects the first pair of sidewalls 26 to define corners 32 and an interior storage compartment. Upper and lower rims 40, 42 extend radially outwardly from the outer sidewall surfaces 38 and the respective upper and outer edges 30, 24.

Figure 2:
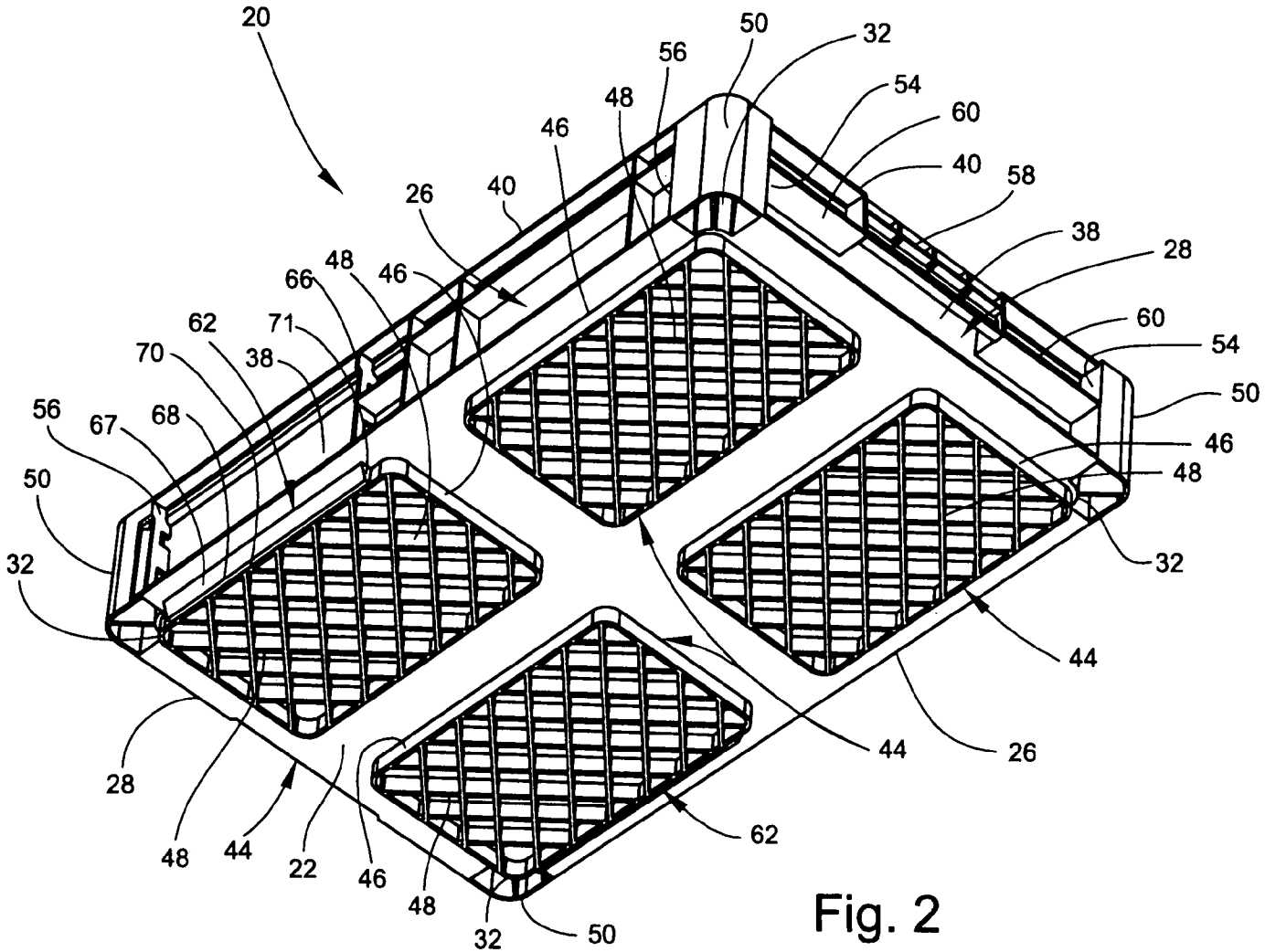
FIG. 2 is a perspective view of the container shown in FIG. 1 illustrating the bottom of the container.
Figure 3:
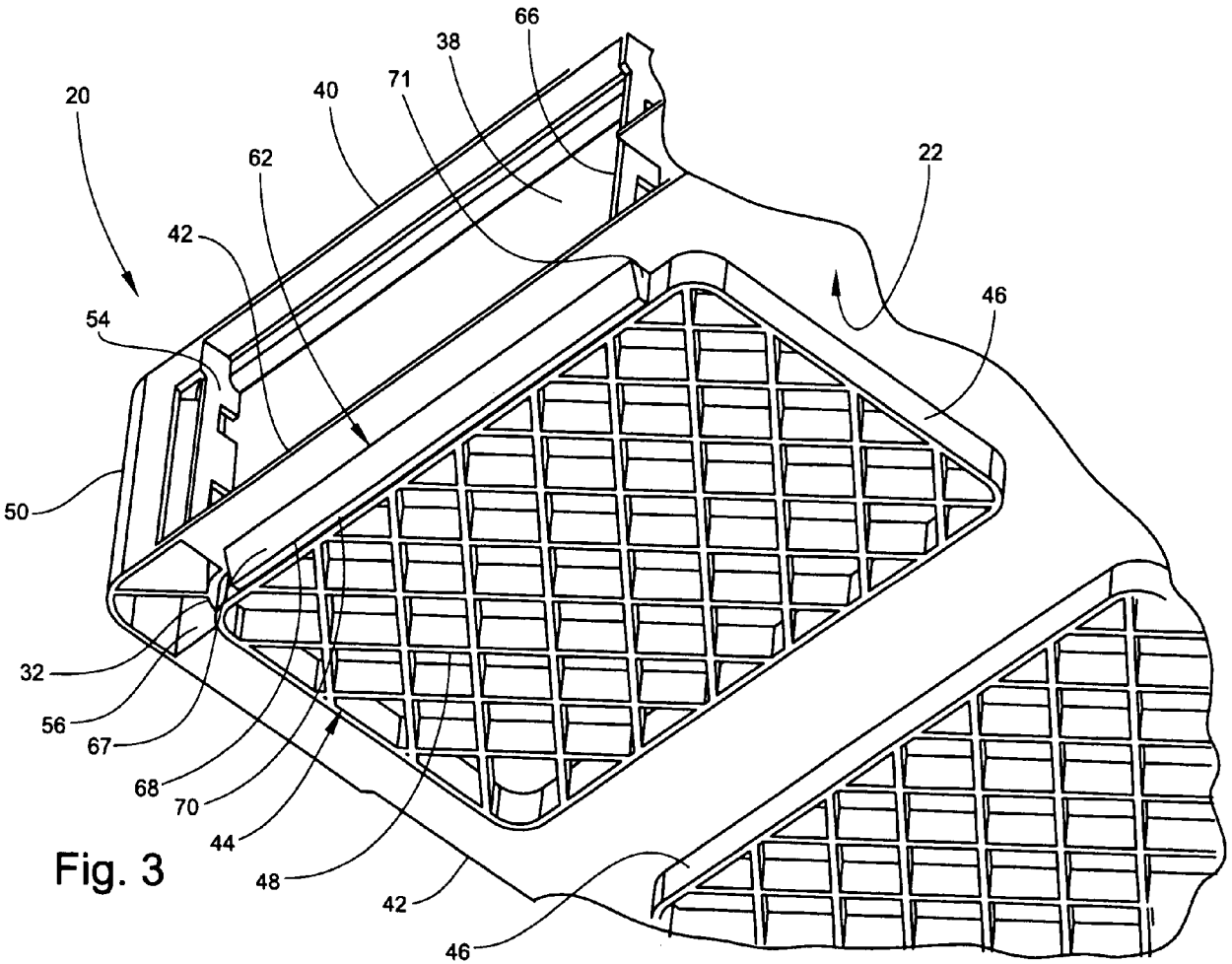
FIG. 3 is a fragmentary perspective view of the container shown in FIG. 2.
Figure 4:
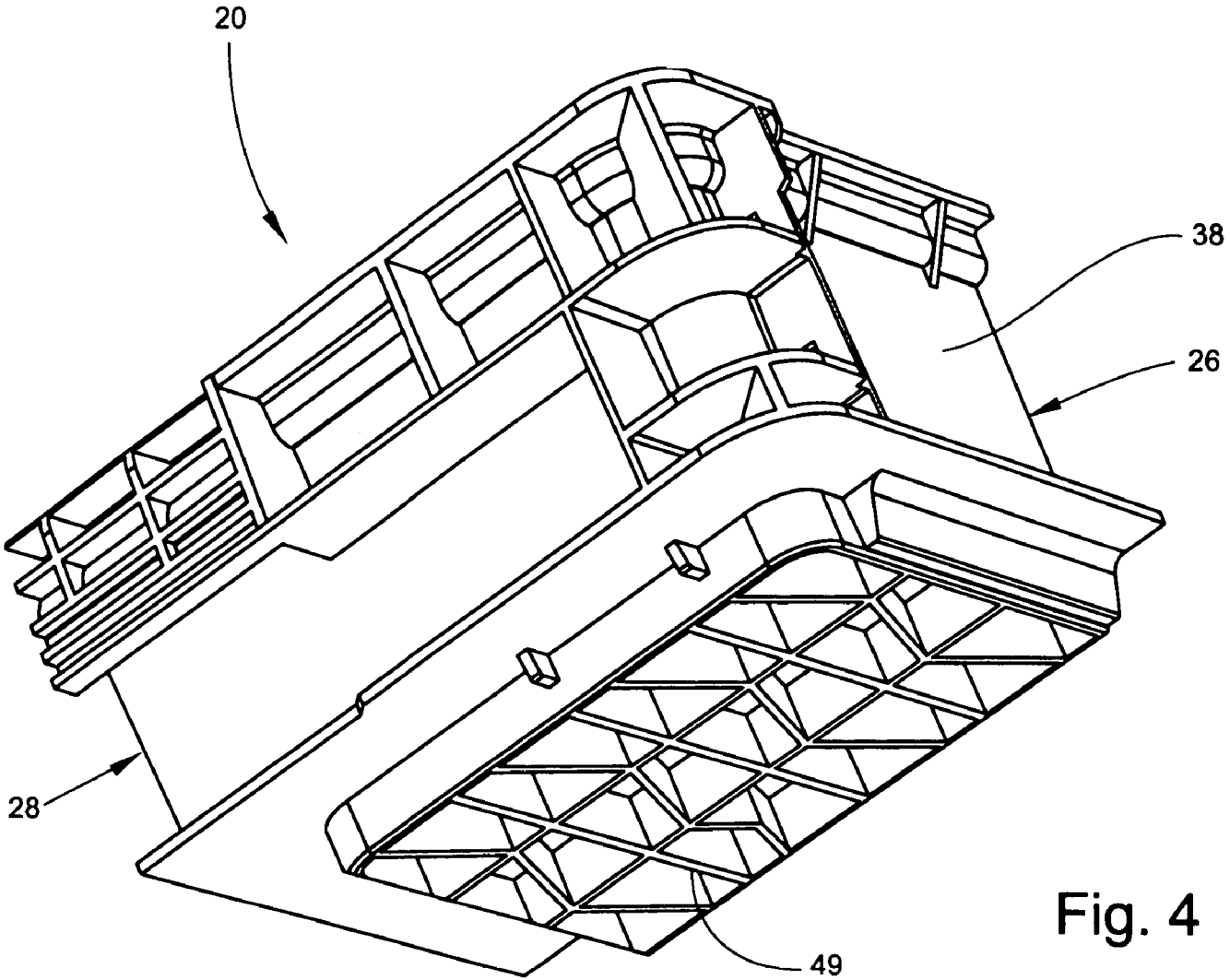
FIG. 4 is a fragmentary, cross-sectional perspective view of a container having a base according to an alternative embodiment of the invention.

As is best shown in FIGS. 2 and 3, a plurality of rectangular pads 44, are disposed on the base 22 and extend therefrom for engaging a floor, table or other surface ("S") upon which the container 20 is positioned. Each foot 44 has a rectangular sidewall 46 and a grid structure 48 for maintaining the container 20 in a stationary position after the feet 46 are placed on a given surface. The feet 44 also permit the container 20 to be stacked on one or more containers having differing footprints. As is described in greater detail below with reference to FIGS. 8 and 9, the rectangular sidewalls 46 and the upper and lower rims 40, 42 are also configured in a manner that permits the container 20 to be vertically stacked on an identical container 20'. A container utilizing an alternative grid structure 49 is shown in FIG. 4.

Referring again to FIG. 1, the sidewalls 26, 28 and corners 32 are stabilized by four corner reinforcement members 50. Each reinforcement member 50 is disposed against a selected one of the corners 32 and has a curved outer surface that extends between first and second end wall segments 54, 56 from the upper rim 40 to the lower rim 42. As is shown in FIG. 1, each reinforcement member 50 is oriented so that the first end wall segment 54 is disposed against the outer sidewall surface 38 of the first sidewalls 26 and the second end wall segment 56 is disposed against the outer sidewall surface 38 of one of the second sidewalls 28.

The container 20 also has a pair of handles 58. Each handle 58 extends from the upper rim 40 and is disposed against the outer sidewall surface 38 of a selected one of the second pair of sidewalls 28. Although any suitable handle may be utilized in the subject invention, the handles 58 of the container 20 shown in FIGS. 1 through 8 are conventional pocket handles. The container 20 may alternatively include a hand opening extending through one or more of each of the sidewalls 26, 28.

The container 20 also includes first and second pairs of intermediate ribs 60. Each pair of ribs 60 are disposed on the outer sidewall surface 38 of one of the second pair of sidewalls 28 and extend therefrom at a generally perpendicular angle. The ribs 60 interconnect the handle 58 with the second end wall segments 56 of the adjacent reinforcement members 50. The ribs 60 also cooperate with the reinforcement members 50 to provide enhanced support to the sidewalls 28 by stabilizing the handles 58 against the sidewall surfaces 38, which in turn helps prevent twisting or other destabilizing movement of the sidewalls 26, 28 relative to the longitudinal axis of the base 22.

The container 20 also includes card holders, or pockets 62, which receive conventional file cards or labels. Although the cards may have any suitable dimensions, the card utilized with the container 20 preferably has a height of 4 inches and a width of 6.5 inches. The pockets 62 retain the cards against the outer sidewall surfaces 38. Although the pockets 62 may be placed in any location relative to the sidewalls 26, 28, each pocket 62 on the container 20 is disposed against the outer sidewall surface 38 of a selected one of the first sidewalls 26 where the lower rim 42 intersects the sidewall 26 and extends below the lower rim 42. Like the cards, the pockets 62 may have any suitable dimensions; however the pockets 62 preferably have a height of about 3.9 inches and a width of about 8.0 inches.

As is shown in FIG. 1, each pocket 62 includes an elongate slot 64 with a tapered portion 65 that extends from the first end wall segment 54 along the intersection of the rim 42 and sidewall 26 to a vertical wall segment 66.

As is best shown in FIG. 3, the pocket 62 is formed by a sidewall 67 that extends from the slot 64 beneath the lower rim 42 to a lower edge 68. A base portion 70 interconnects the lower edge 68 with the sidewall 46 of an adjacent foot 44. Opposed end portions 71 similarly connect the ends of the sidewall 67 and base portion 70 to the sidewall 46.

Figure 5:
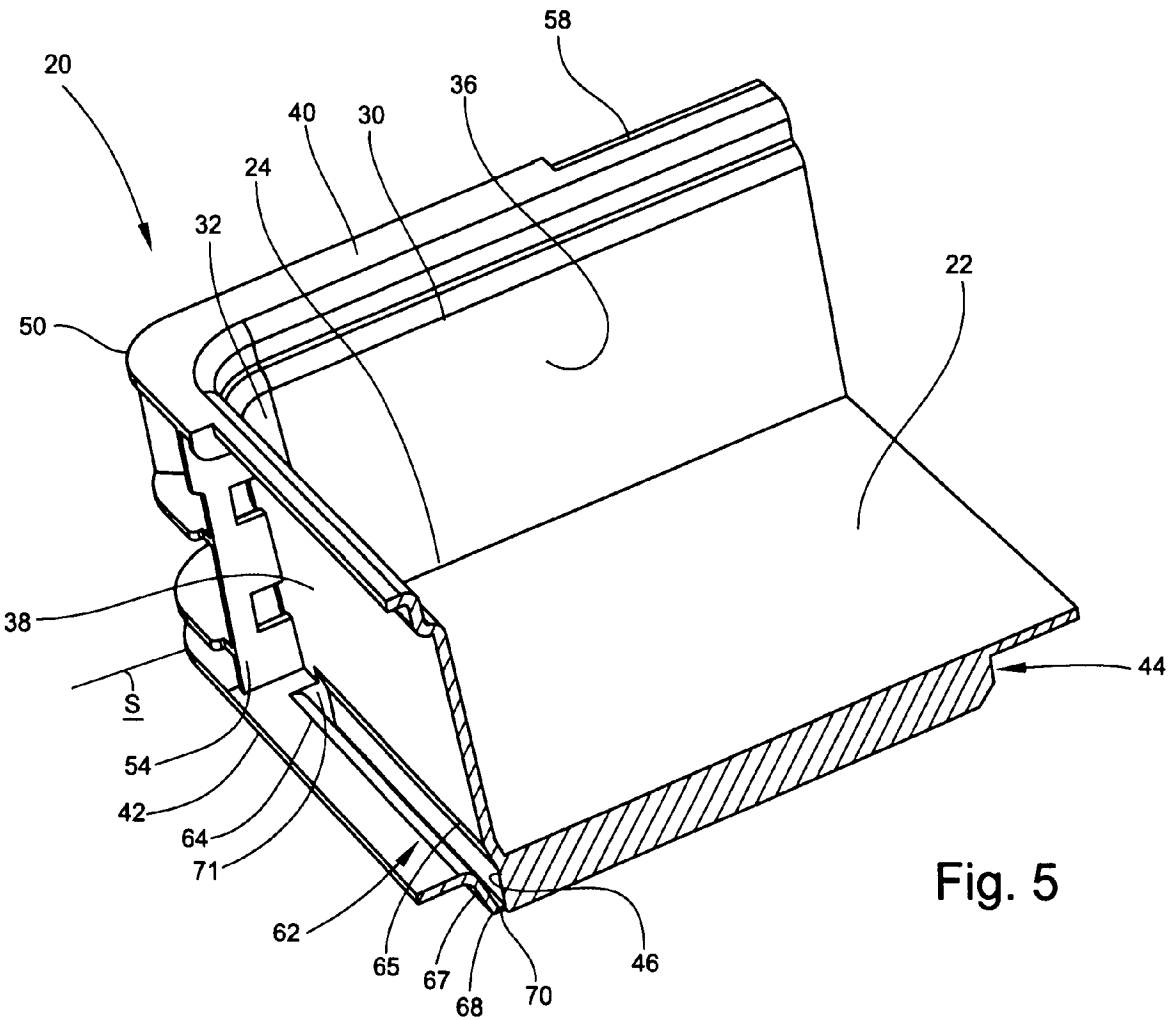
FIG. 5 is fragmentary, cross-sectional perspective view of the container according to FIG. 4 showing an interior and exterior corner detail.
Figure 6:
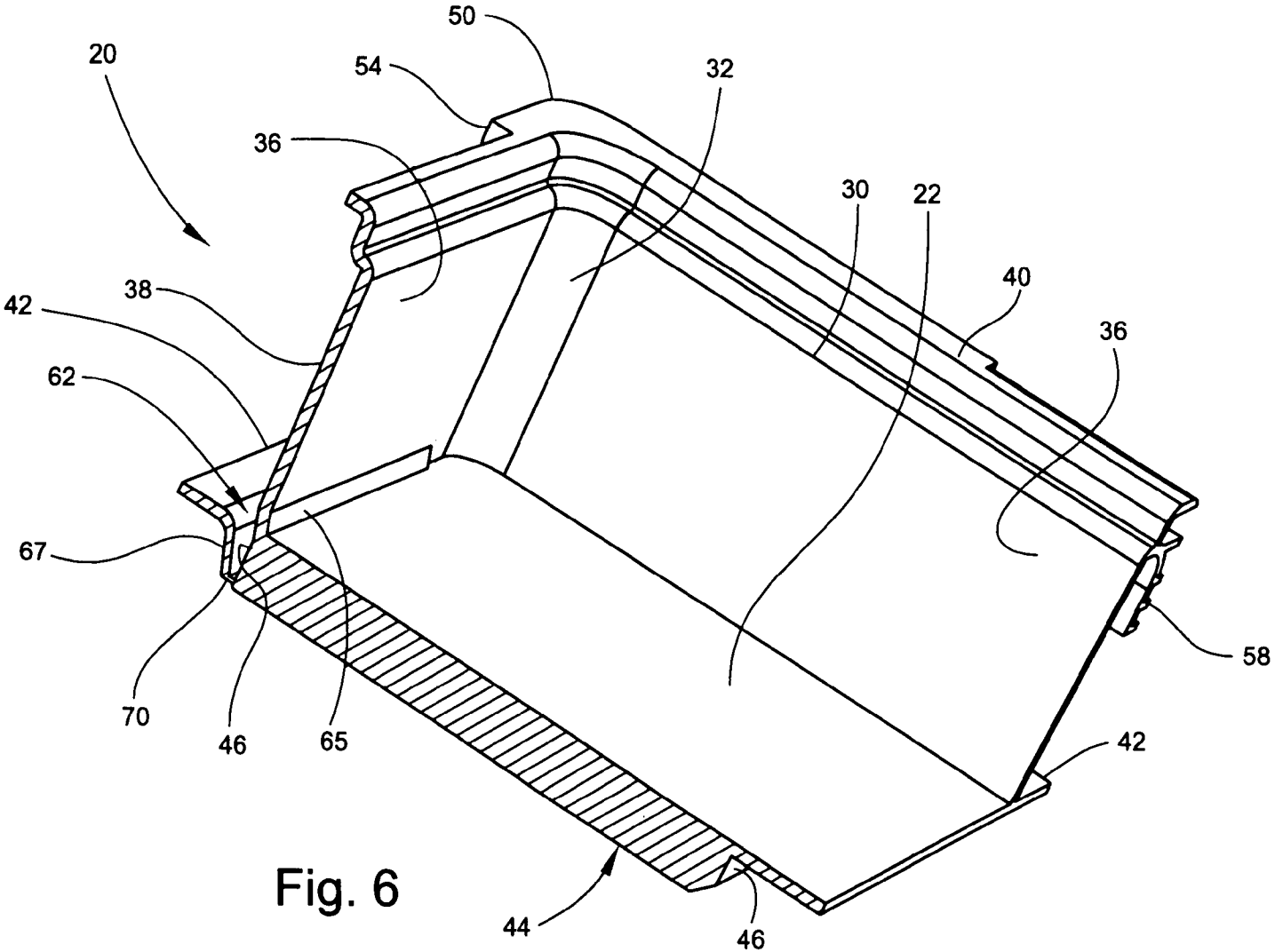
FIG. 6 is a fragmentary, cross-sectional perspective view of the container according to FIG. 4 showing a bottom corner.

Referring now to FIGS. 5 and 6, the interconnected sidewall 46, base portion 70 and elongate sidewall 64 collectively define a cavity within which a card or other label may be received.

Figure 7:
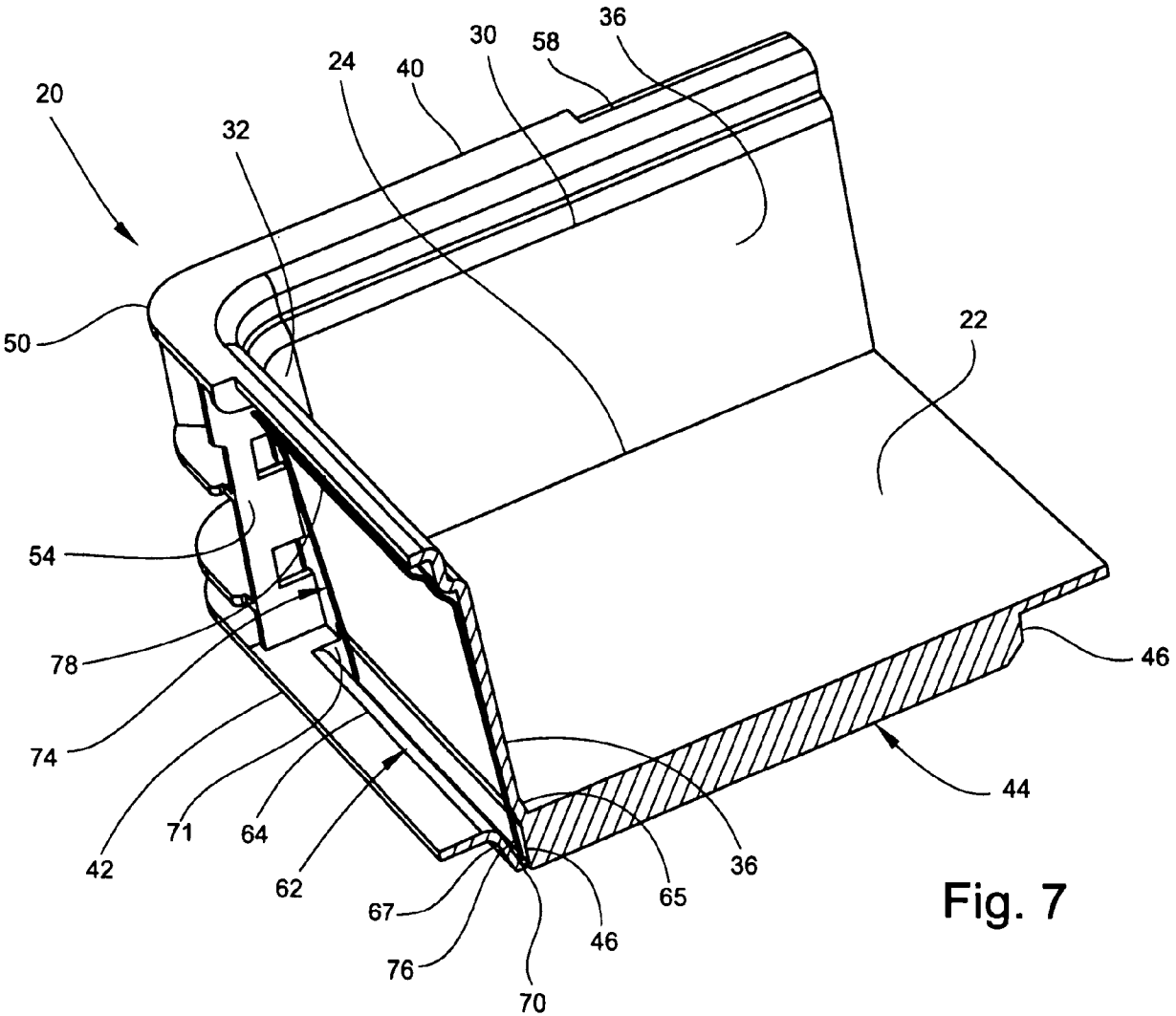
FIG. 7 is a cross-sectional perspective view of the container with an information card inserted in the pocket.

FIG. 7 shows the container 20 with a conventional card 74 inserted in the pocket 62. The lower edge 76 of the card 74 is inserted through the slot 64 and into the pocket 62 until the lower edge 76 abuts the base portion 70. Because the pocket 62 extends beneath the lower rim 42, the lower edge 76 of the card 74 is positioned below the base 22 in a protected position adjacent the sidewall 46. Positioning the pocket 62 beneath the lower rim 42 in this manner creates additional space along the outer sidewall surface 38 adjacent the upper edge 30 and beneath the upper rim 40 against which the card 74 may be positioned. This prevents the top edge 78 of the card 74 from extending beyond the upper rim 40, which in turn protects the top edge 78 from being folded, torn or inadvertently damaged as the container 20 is moved or otherwise handled. In particular, the container 20 may receive a card storage device such as shown in applicant's United States Letters Patent Des. 423,220.

Figure 8:
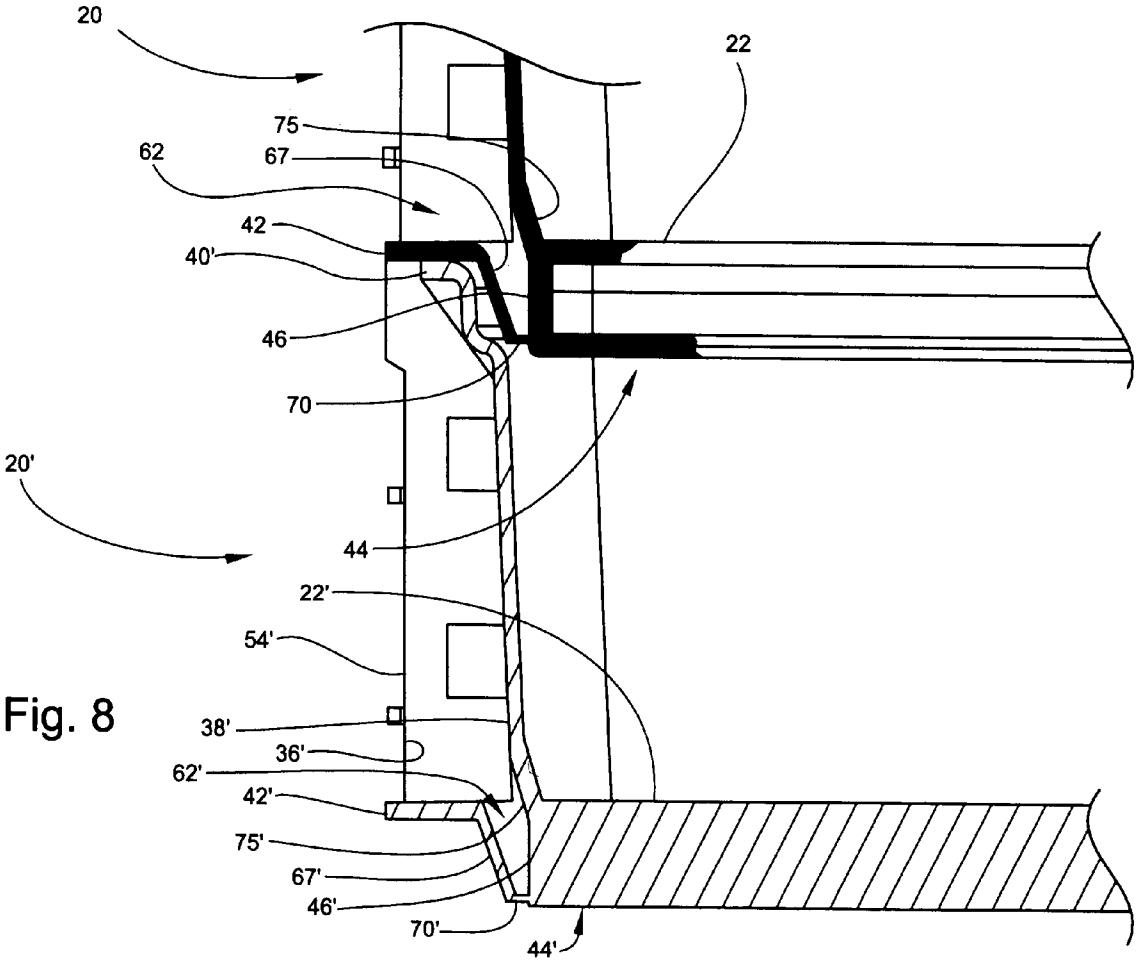
FIG. 8 is a partial cross-sectional view of a pair of interstacked containers.
Figure 9:
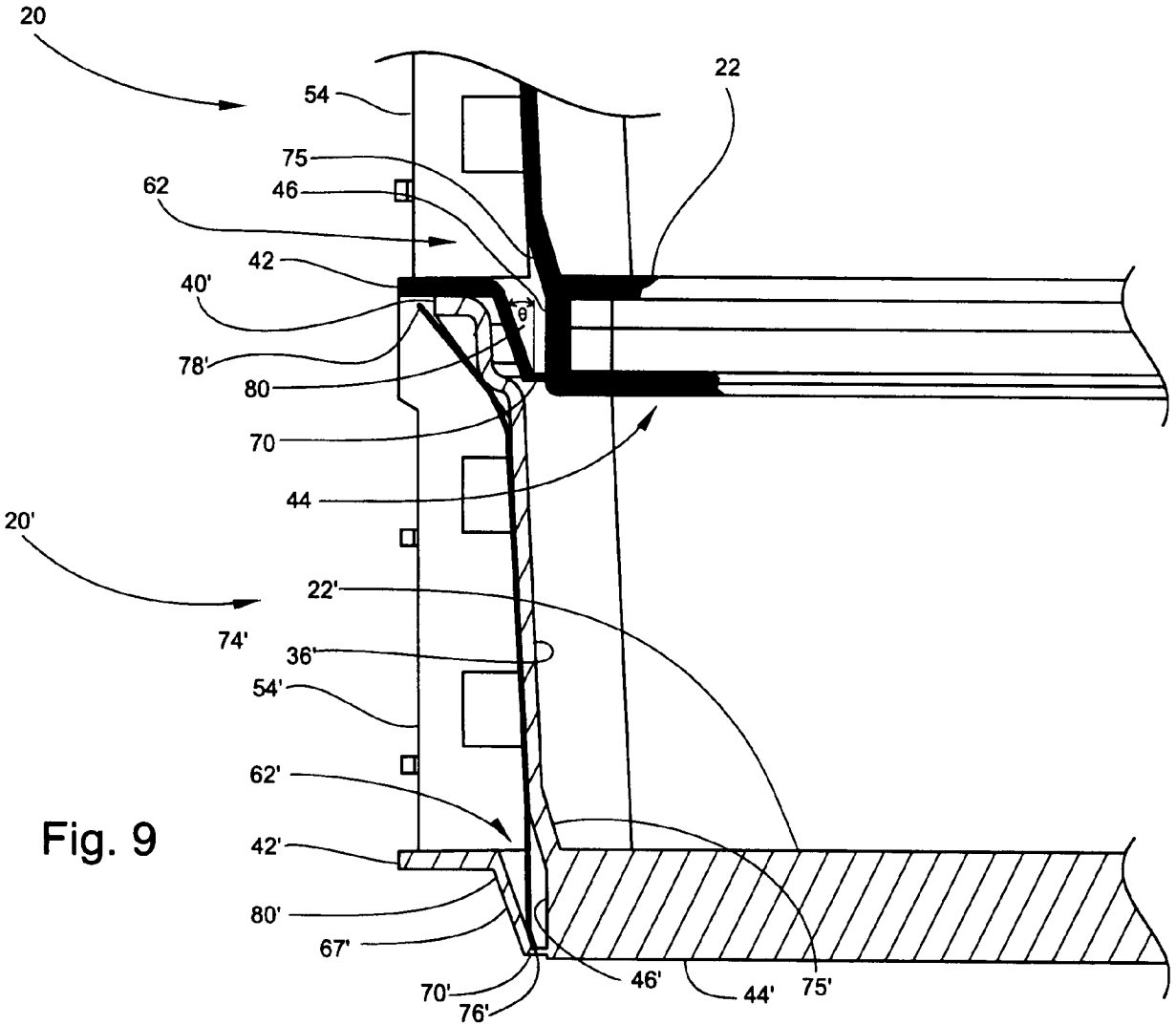
FIG. 9 is a partial cross-sectional view of the containers shown in FIG. 8 with an information card inserted in the pocket of the lowermost container.

Referring now to FIGS. 8 and 9, the pocket 62 is specifically shaped to permit the container 20 to be stacked on top of a like container 20'. In particular, the elongate sidewall 64 extends at an angle "θ" from the base portion 70 to the lower rim 42. The lower rim 42 extends from the sidewall 64 generally parallel to the base 22 to define a shoulder 80. This structure allows the container 20 to be superposed upon container 20' so that the upper rim 40' engages the shoulder 80 of the container 20. This maintains the containers 20, 20' in a stacked position without compromising the storage area available within the interior of the container 20'. As is shown in FIG. 9, when in the stacked position, the lower rim 42 of the container 20 extends just beyond the top edge 78' of a card 74' positioned in the pocket 62' and thus further protects the card 74' from damage.

The container 20 may be formed from any suitable material, but is preferably formed from either high density polyethylene or polypropylene. Furthermore, the container 20 may have any suitable dimensions, depending upon the type of application for which the container 20 is intended to be used.

Figure 10:
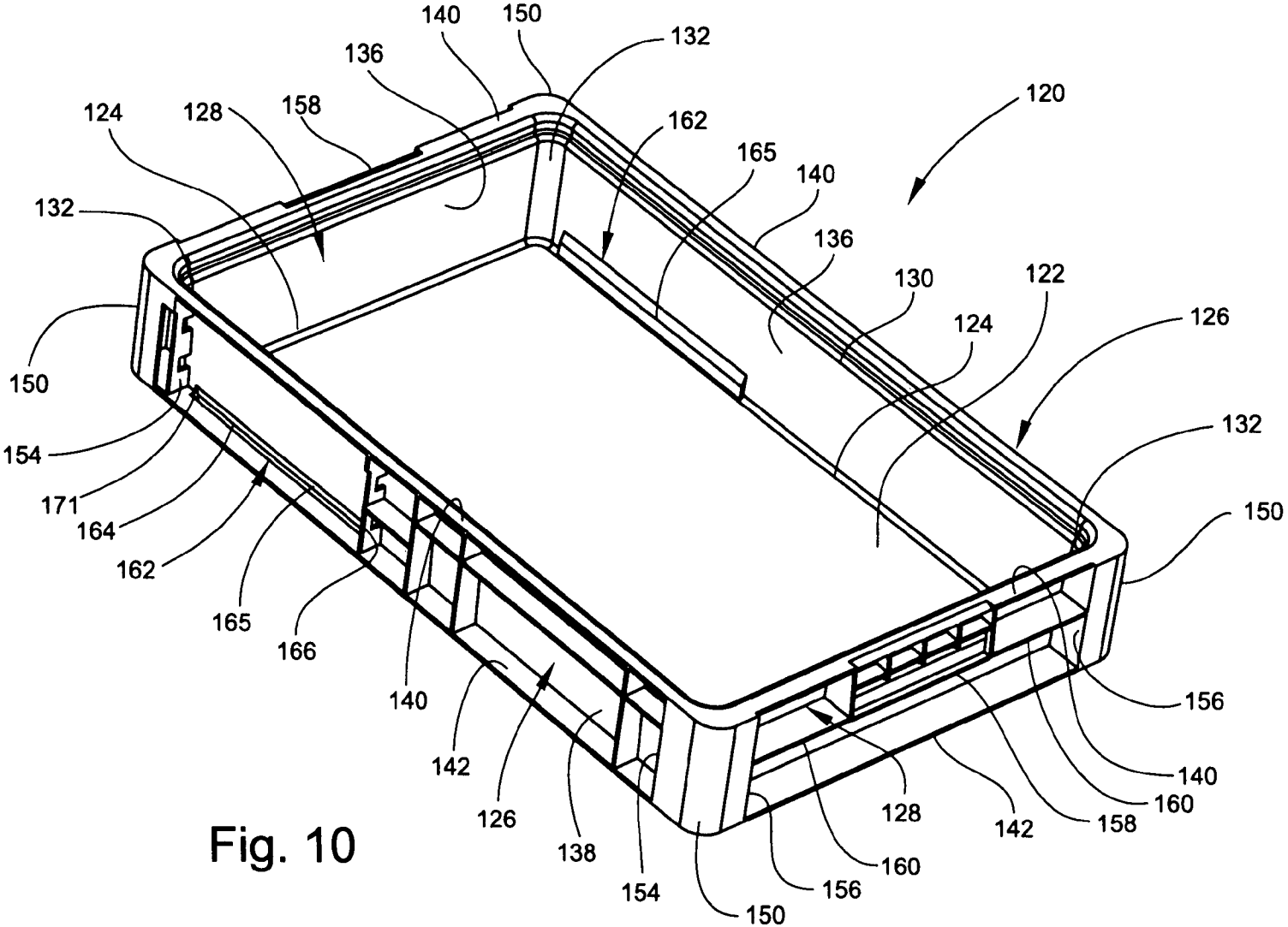
FIG. 10 is a perspective view of a container according to another embodiment of the invention.
Figure 11:
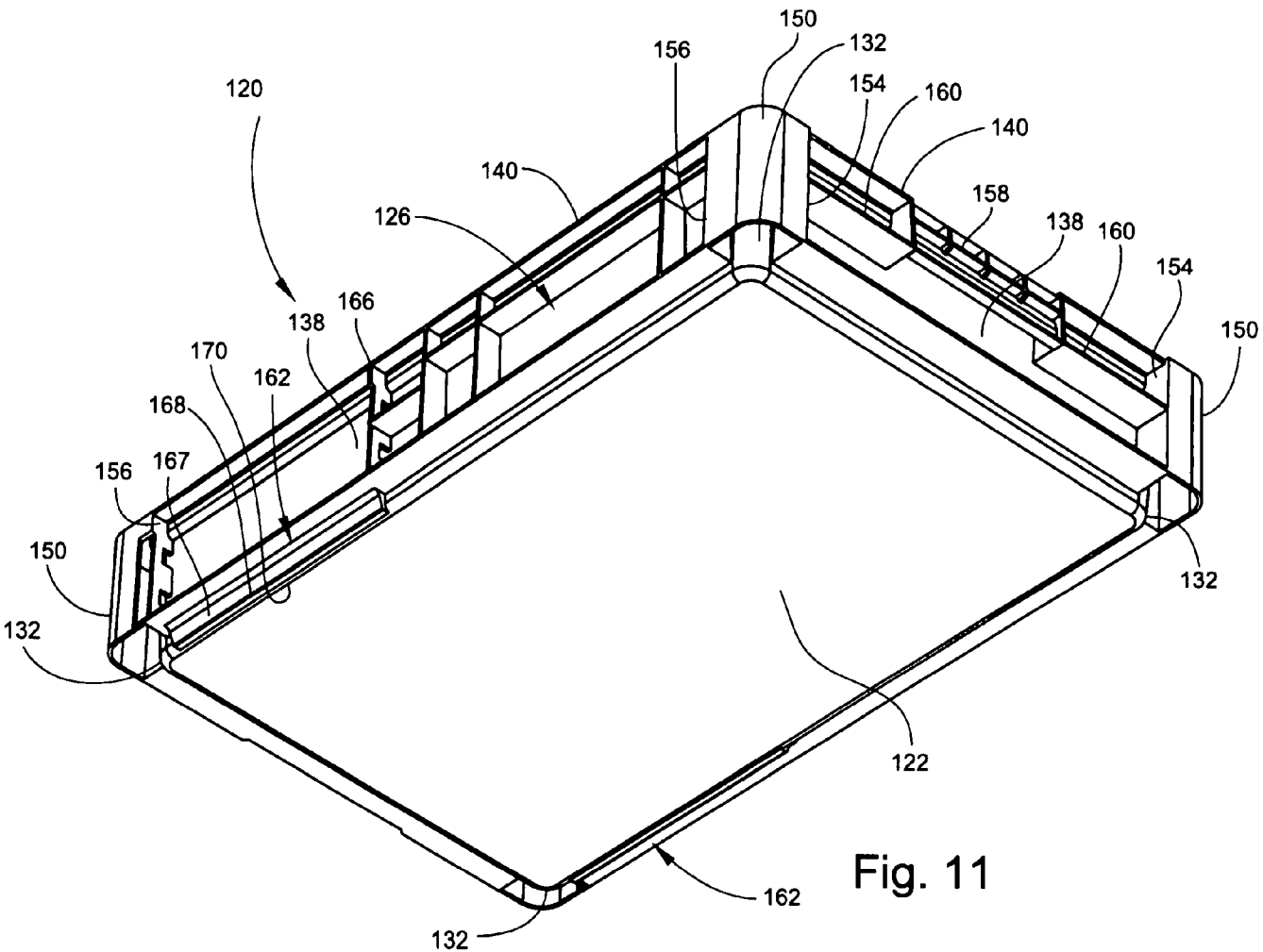
FIG. 11 is a perspective view of the bottom of the container shown in FIG. 10.
Figure 12:
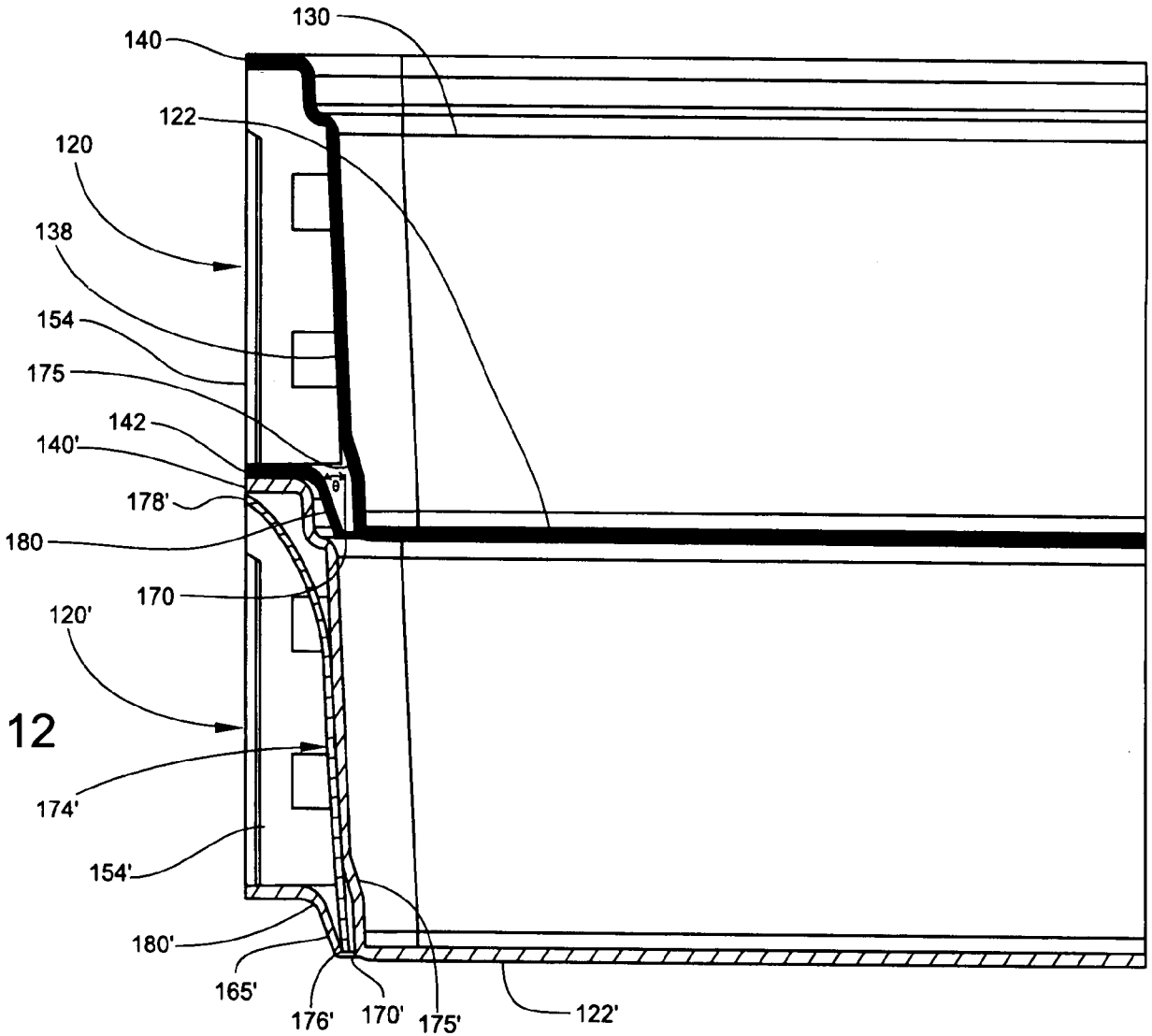
FIG. 12 is a partial cross-sectional view of a pair of interstacked containers of the type shown in FIG. 10.
Figure 13:
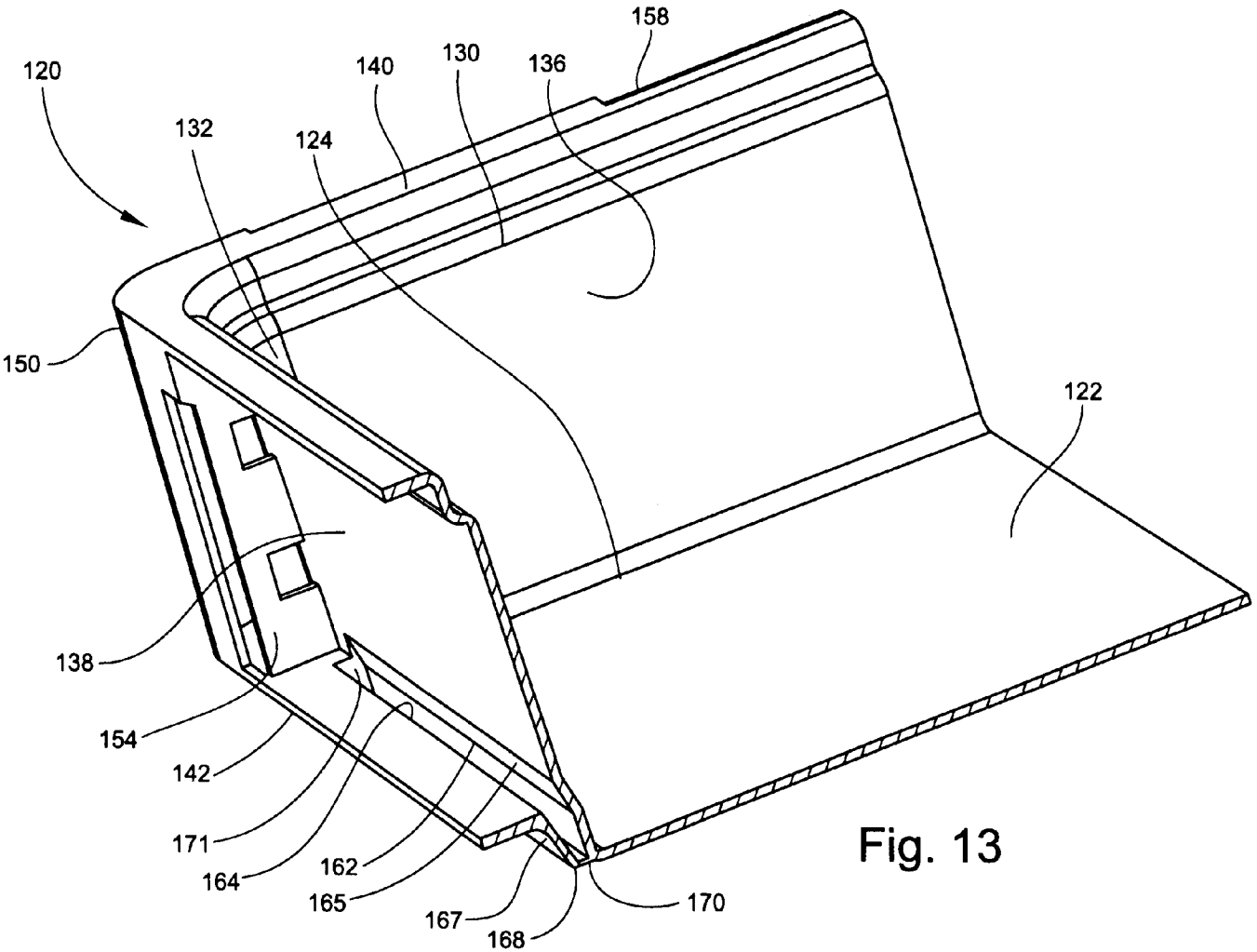
FIG. 13 is a fragmentary, cross-sectional perspective view of the container shown in FIG. 10.
Figure 14:
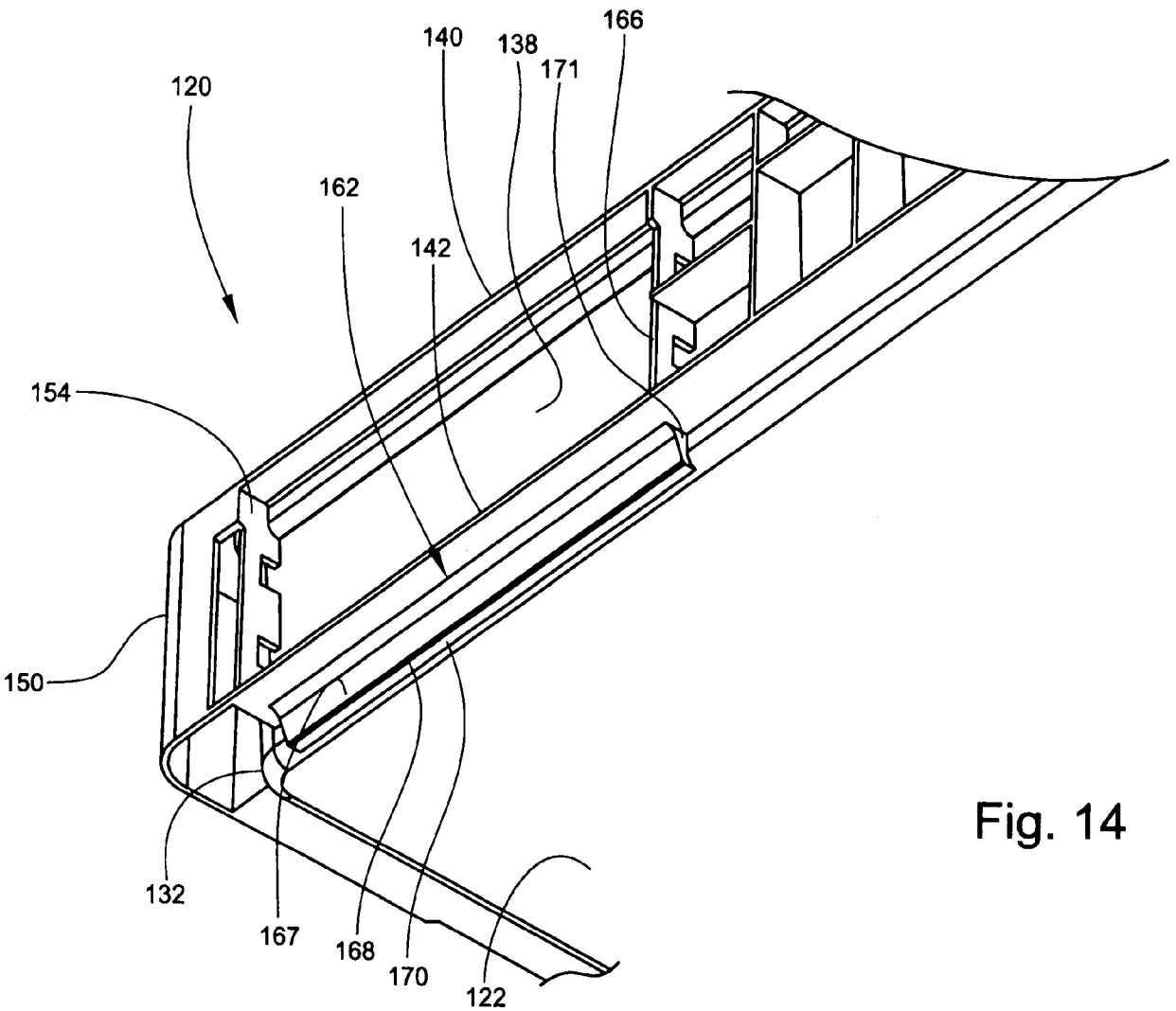
FIG. 14 is a partial perspective view of the bottom of the container shown in FIG. 10.

Referring now to FIGS. 10 and 11, a container according to an alternative embodiment of the invention is shown generally at 120. With the exception of the location of the pockets 162 and differences in the structure of the base 122 of container 120, the container 120 includes the same components and is fabricated from the same materials as the container 20.

As is shown in FIGS. 10, 11, 12, 13 and 14, the container 120 lacks the feet 44 of the container 20 and instead utilizes the base 122 to engage any surface upon which the container 120 may ultimately rest. Removing the feet 44 does not alter the structure or function of the pockets 162. To the contrary, the pockets 162 are repositioned to take advantage of the existing structure of the base 122.

Like the pockets 62 which extend beneath the lower rim 42, the pockets 162 of the container 120 extend beneath the lower rim 142. However, rather than being connected to a foot that protrudes from the base, the base portion 170 of each pocket 162 extends from the lower edge 168 of the elongate sidewall 167 to the outer sidewall surface 138 adjacent the base 122. The end portions 171 of the pocket 162 interconnect the opposed ends of the elongate sidewall 167 and base portion 170 and are attached directly to the outer sidewall surface 138. This positions the pocket 162 so that the elongate sidewall 167 extends between the lower rim 142 and the outer edge 130 of the base 122 without requiring any alterations to the dimensions, structure or function of the pocket 162.

The pockets of the present invention may be formed on or attached to a container regardless of the type of base being utilized. The pockets may also have different dimensions to accommodate different sized cards or be positioned at different locations on a container. By way of non-limiting example, a container according to an alternative embodiment of the invention is shown generally at 220 in FIGS. 15 and 16. With the exception of the location and components of the pockets 260 and the smaller dimensions of the container 220, the container 220 is formed using the same materials and has the same components as the container 20.

Figure 15:
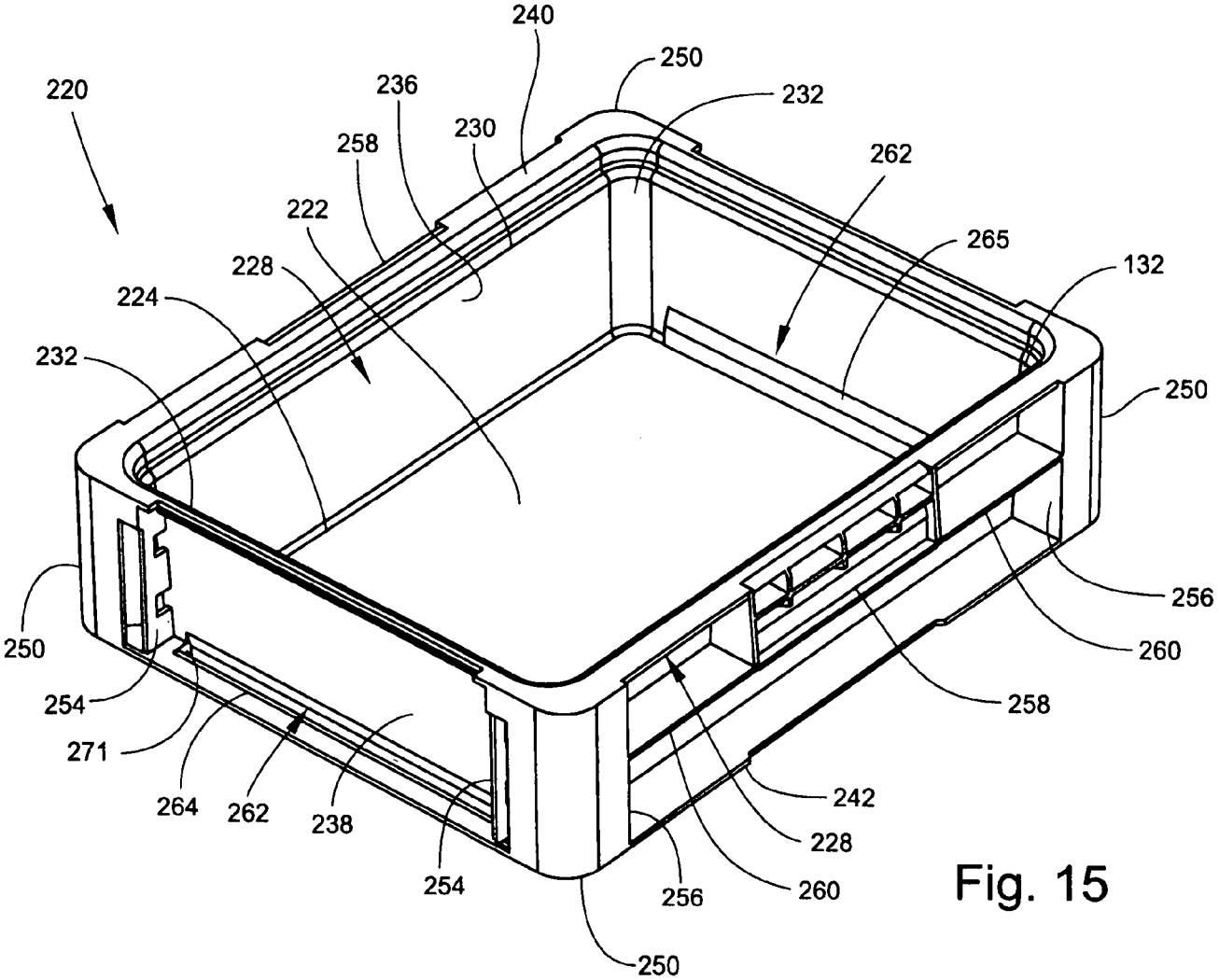
FIG. 15 is a perspective view of a container according to another embodiment of the invention.
Figure 16:
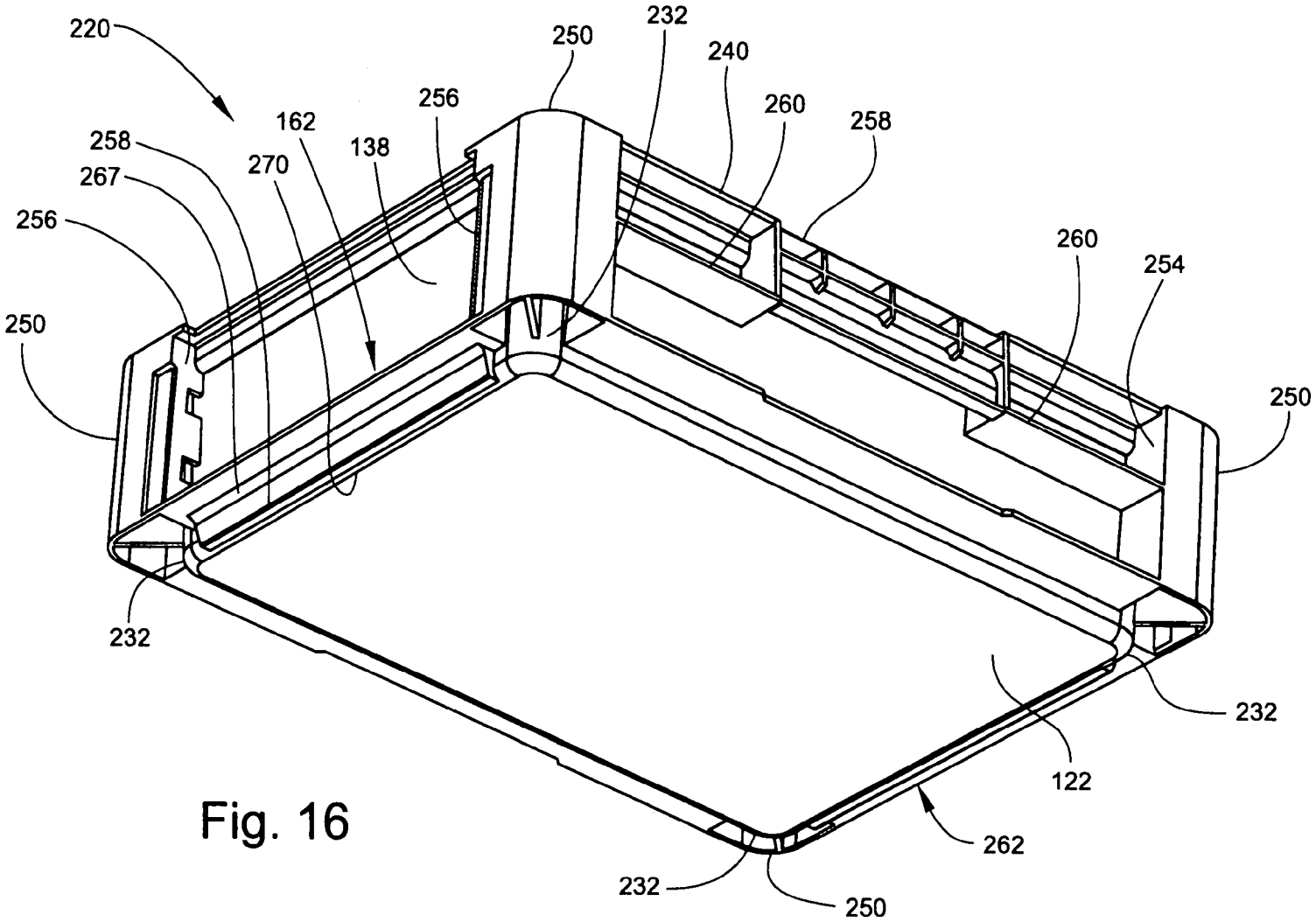
FIG. 16 is a perspective view of the bottom of the container shown in FIG. 15.

The pockets 262 of the container 220 are designed to accommodate the shorter length of the sidewalls 226 without compromising the area along the outer sidewall surface 38 required to adequately support and protect a conventional information card. As is shown in FIG. 15, the pockets 262 do not extend to an intermediate wall segment disposed on the outer surface of the sidewall. Each pocket 262 instead extends along the length of the sidewall 238 between the first wall segments 254 of the respective corner reinforcement members 250. As is shown in FIG. 16, the pockets 262 extend from the lower rim 162 and are connected to the sidewall 232 adjacent the outer edge 232 of the base 122 in a manner similar to that of the pockets 162 on the container 120. While the cards inserted in the pockets 262 may have any suitable dimensions, the cards preferably have a height of about 3.25 inches and a width of about 7.5 inches.

A storage container is disclosed above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A container, comprising:

(a) a base that includes feet that have a lower surface dimensioned to engage a support surface;

(b) first and second pairs of spaced-apart, opposed sidewalls projecting from the base to collectively form a storage compartment and to define an upper edge of the container;

(c) a lower rim positioned between the lower surface of the feet and the upper edge of the container and adapted for engaging and being supported by another container; and (d) a pocket having a bottom wall positioned below the lower rim for receiving and retaining an information card therein, the pocket being formed by:

(i) first and second spaced-apart wall segments projecting away from one of the sidewalls; and (ii) an elongate slot defined between the spaced-apart wall segments and a lower rim segment between the spaced-apart wall segments for receiving and retaining the card therein.

2. A container according to claim 1, wherein the elongate slot has a downwardly tapered portion for wedging the information card therein to retain the card in the pocket.

3. A container according to claim 1, wherein the upper rim provides support and protection to the upper edge of the information card.

4. A container according to claim 1, wherein the pocket is adapted to receive and retain therein a separate card storage device.

5. A container according to claim 1, and including reinforcement members for stabilizing corners of the sidewalls.

6. A container according to claim 1, wherein the pocket has a height of about 3.9 inches and a width of about 8.0 inches.

7. A container, comprising:

(a) a base;

(b) first and second pairs of spaced-apart, opposed sidewalls projecting from the base to collectively form a storage compartment;

(c) an upper rim and a lower rim, the upper rim positioned on the sidewalls for engaging and supporting the base of another container, and the lower rim positioned adjacent the base and adapted for engaging and being supported by an upper rim of another container; and (d) a pocket for receiving and retaining an information card therein, the pocket being formed by:

(i) first and second spaced-apart wall segments projecting from one of the sidewalls;

(ii) an elongate slot defined by the sidewall between the spaced-apart wall segments and a lower rim segment between the spaced-apart wall segments, the elongate slot having a tapered portion extending downwardly to a bottom adjacent to the base and adapted for wedging the information card therein to retain the card in the pocket, the bottom being positioned such that the lower rim is between the bottom of the slot and the upper rim;

(iii) the upper rim defining a support for an upper edge of the card;

whereby the upper and lower rims, elongate slot, and wall segments collectively form the pocket on the sidewall of the container.

8. A container according to claim 7, wherein the pocket is adapted to receive a card storage device therein.

9. A container according to claim 7, and including reinforcement members for stabilizing the corners of the sidewalk.

10. A container according to claim 7, wherein the pocket has a height of about 3.9 inches and a width of about 8.0 inches.

* * * * *

UNITED STATES PATENT AND TRADEMARK OFFICE

CERTIFICATE OF CORRECTION

PATENT NO. : 7,234,598 B2
APPLICATION NO. : 11/081204
DATED : June 26, 2007
INVENTOR(S) : McDade It is certified that error appears in the above-identified patent and that said Letters Patent is hereby corrected as shown below:

Column 8, line 10, delete “walk” and enter --walls--.

Signed and Sealed this

Fourteenth Day of August, 2007

JON W. DUDAS
*Director of the United States Patent and Trademark Office*